US007360577B2

(12) United States Patent
Pederson et al.

(10) Patent No.: US 7,360,577 B2
(45) Date of Patent: Apr. 22, 2008

(54) PROCESS FOR LOST-FOAM CASTING WITH CHILL

(75) Inventors: Thomas C. Pederson, Rochester Hills, MI (US); Andrew R. Moore, Washington, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 31 days.

(21) Appl. No.: 11/475,500

(22) Filed: Jun. 27, 2006

(65) Prior Publication Data

US 2007/0295469 A1 Dec. 27, 2007

(51) Int. Cl.
*B22C 9/02* (2006.01)

(52) U.S. Cl. ..... 164/34; 164/516

(58) Field of Classification Search ..... 164/34–36, 164/516–519
See application file for complete search history.

(56) References Cited

U.S. PATENT DOCUMENTS 4,520,858 A 6/1985 Ryntz, Jr. et al. ..... 164/34
2004/0244934 A1* 12/2004 Narushima et al. ..... 164/34

* cited by examiner

*Primary Examiner*—Kuang Lin

(57) ABSTRACT

Process for the Lost-foam casting of aluminum or magnesium including spacing the cooling face of a chill from a selected surface of a pyrolizable polymeric foam pattern so as to provide at least a 0.5 mm gap therebetween, and filling the gap with Al or Mg melt so as to displace any pyrolysis products therein away from the cooling face, and otherwise prevent such products from becoming trapped by the melt against the cooling face of the chill.

7 Claims, 5 Drawing Sheets

PROCESS FOR LOST-FOAM CASTING WITH CHILL

TECHNICAL FIELD

This invention relates to a process for the "lost-foam" casting of aluminum or magnesium alloys using chills to rapidly extract heat from the solidifying metal in the vicinity of the chill, and to impart a high quality surface finish.

BACKGROUND OF THE INVENTION

The so-called "lost-foam" casting process is a well-known technique for producing metal castings wherein a fugitive, pyrolizable, polymeric foam pattern is covered with a thin, permeable, refractory coating, and embedded in a mold formed of unbonded refractory particles (e.g. sand) to form a molding cavity within the bed of particles. Metal melt, e.g., aluminum or magnesium, is then introduced into the mold cavity to pyrolize the foam, and displace it with melt. Gaseous and liquid pyrolysis products escape the molding cavity through the permeable refractory coating into the interstices between the unbonded refractory particles. The most popular polymeric foam pattern comprises expanded polystyrene foam (EPS) having densities varying from 1.2 to 1.6 pounds per cubic foot. Other pyrolizable polymeric foams such as polymethylmethacrylate (PMMA), and copolymers are also known. The melt may either be gravity-cast (i.e. melt is poured from an overhead ladle or furnace), or countergravity-cast (melt is forced upwardly e.g. by vacuum or low pressure) into the bottom of the mold from an underlying vessel.

In gravity-cast lost-foam processes, the metallostatic head of the melt is the driving force for filling the mold with melt. Gravity-cast lost-foam processes are known that (1) top-fill the mold cavity by pouring the melt into a basin overlying the pattern so that the melt enters the mold cavity through one or more gates located above the pattern, or (2) bottom-fill the mold cavity by pouring the melt into a vertical sprue that lies adjacent the pattern and extends from above the mold cavity to a gate(s) at the bottom of the mold cavity for filling the mold cavity from beneath the pattern. According to one countergravity-casting technique, known as "low pressure lost-foam casting", melt is contained in a crucible that is contained within a sealed vessel that underlies the mold. A filler-tube extends upwardly from within the melt in the crucible to the gate of an overlying, bottom-gated, unbonded refractory particle mold. When the vessel is pressurized (e.g. with nitrogen), melt rises up the filler-tube and into the mold cavity, displacing the pyrolizable foam therein and filling the molding cavity. In low-pressure lost-foam casting, the driving force for moving the melt into the mold is gas pressure applied to the sealed vessel containing the crucible.

It is known to provide one or more unobstructed, foam-free, melt flow-channels, or shafts, in the pattern through which the melt can rapidly flow directly to selected regions of the pattern. Such melt flow-channels are often called "lighteners", and are commonly formed at the joints between individual pattern segments that are joined together to form a single pattern, or as interconnected internal voids that transect the segments. Lighteners may also be formed by molding the foam pattern around an insert (e.g. a rod) and subsequently withdrawing the insert from the pattern to leave a foam-free shaft.

It is known to use chills with empty-cavity casting processes to locally cool a region of a casting in the vicinity of the chill at higher rates than other regions of the casting are cooled in order to reduce porosity, refine the microstructure and enhance the physical properties of the casting. The use of chills with lost-foam casting has also been proposed. For example, Ryntz Jr. et al. U.S. Pat. No. 4,520,858, which is assigned to the assignee of the present invention, and hereby incorporated herein by reference, glues the cooling face of a chill directly onto the surface of an EPS foam pattern using an adhesive that vaporizes under the heat of the melt. Chills are made from materials, such as metals, that have high thermal diffusivities (i.e. the quotient of the division of the material's thermal conductivity by the product of its specific heat times its density), which is a measure of the ability of the material to absorb heat. Copper, cast iron and graphite are known to be suitable chill materials for casting aluminum, and may be water-cooled for added effectiveness. The amount of heat a chill can absorb is also a function of the mass of the chill (i.e. larger chills can absorb more heat).

Lost-foam castings made from molds having chills whose cooling faces contact the pattern develop a rough surface on the casting at the site where the chill engages the casting. In this regard during casting, liquid pyrolysis products from the pyrolysis of the foam pattern become trapped between the advancing metal front and the cooling face of the chill where they are transformed into large volumes of gas that cannot escape through the chill. Rather, they are forced to vent along the interface between the chill and the melt, or into the melt adjacent the interface, which creates a rough surface characterized by a heterogeneous assortment of shallow hills and valleys similar in appearance to a water-eroded surface [e.g. see FIG. 4(*c*)]. The rough surface not only detracts from the appearance and utility of the casting, but also can reduce the heat transfer between the melt and the cooling face.

SUMMARY OF THE INVENTION

The present invention uses chills in the lost-foam process without creating a rough surface on the casting at the casting-chill interface. More specifically, the present invention involves a lost-foam casting process which includes the principle steps of: embedding a pyrolizable polymeric foam pattern in a mold comprising a bed of unbonded refractory particles (e.g. sand) to form a molding cavity in the bed; introducing metal melt into the molding cavity to pyrolize the foam, displace the pattern with the melt, and shape the melt in the molding cavity. The invention is an improvement to the lost-foam process that comprises: positioning a chill opposite a selected surface of the pattern, which chill has a cooling face that confronts the selected surface and is spaced from the selected surface by a gap having a width greater than 0.5 mm; and introducing melt into the gap so as to provide a melt front that moves into the gap and displaces any pyrolysis products therein away from the cooling face, to thereby prevent entrapment of pyrolysis products by the molten metal against the cooling face. The chill is attached (e.g. perimeter-glued) to the pattern with spacers that may be discrete pieces (e.g. of mineral fiber), or preferably formed integrally with the pattern. According to one embodiment of the invention, the melt is supplied first to the gap, and thence to the pattern shaping the molding cavity. According to another embodiment, the mold includes a gate remote from the chill for admitting melt into the molding cavity, an inlet for admitting melt into the gap, and a lightener communicating the gate with the inlet, and the melt is supplied substantially simultaneously to the molding cavity and to the lightener for delivery to the gap before the selected surface of the pattern opposite the chill paralyzes.

DESCRIPTION OF EXEMPLARY EMBODIMENTS OF THE INVENTION

Figure 1:
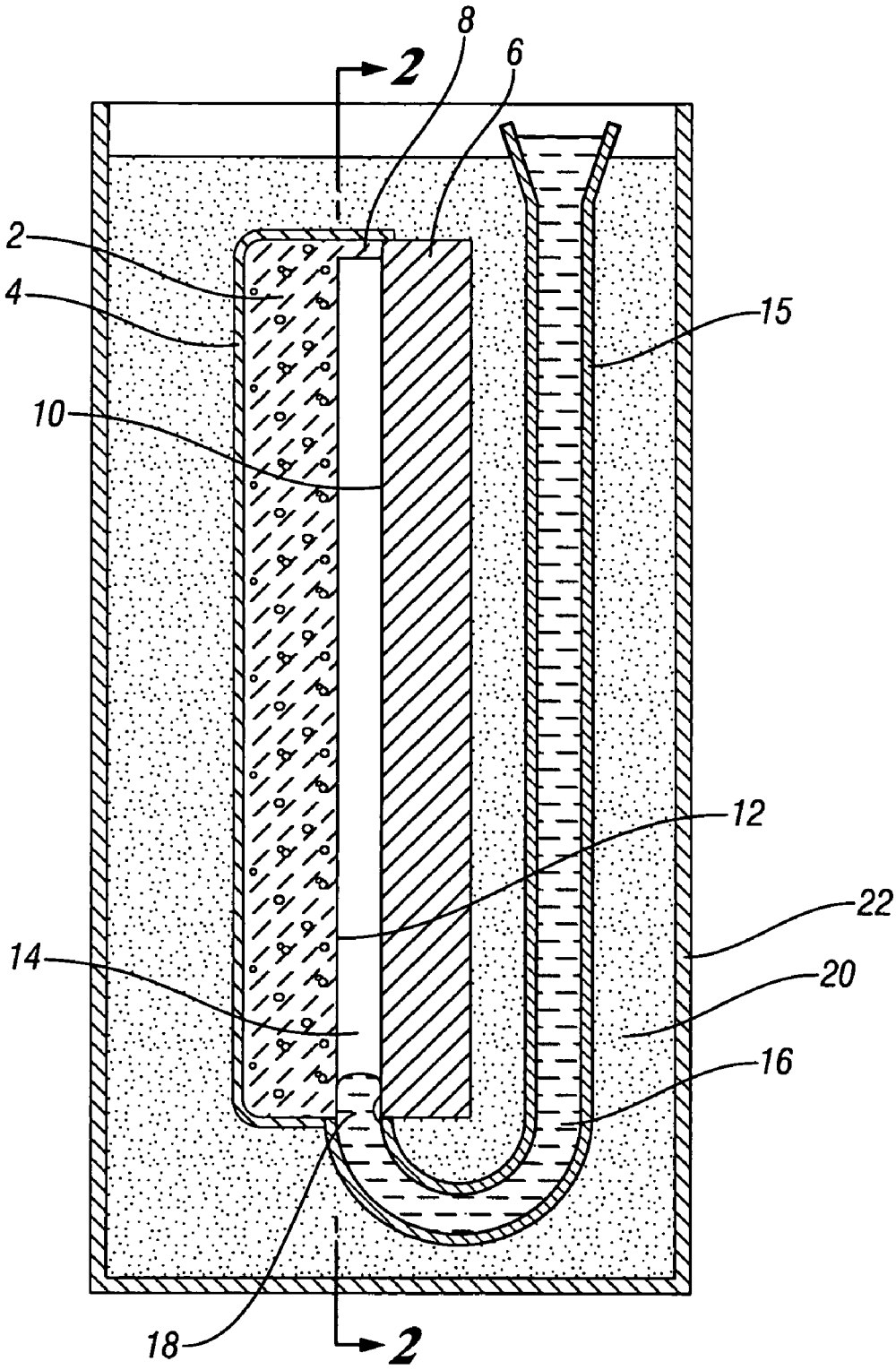
FIG. 1 is a side, section view of a lost-foam mold with embedded pattern and chill according to one embodiment of the present invention.
Figure 2:
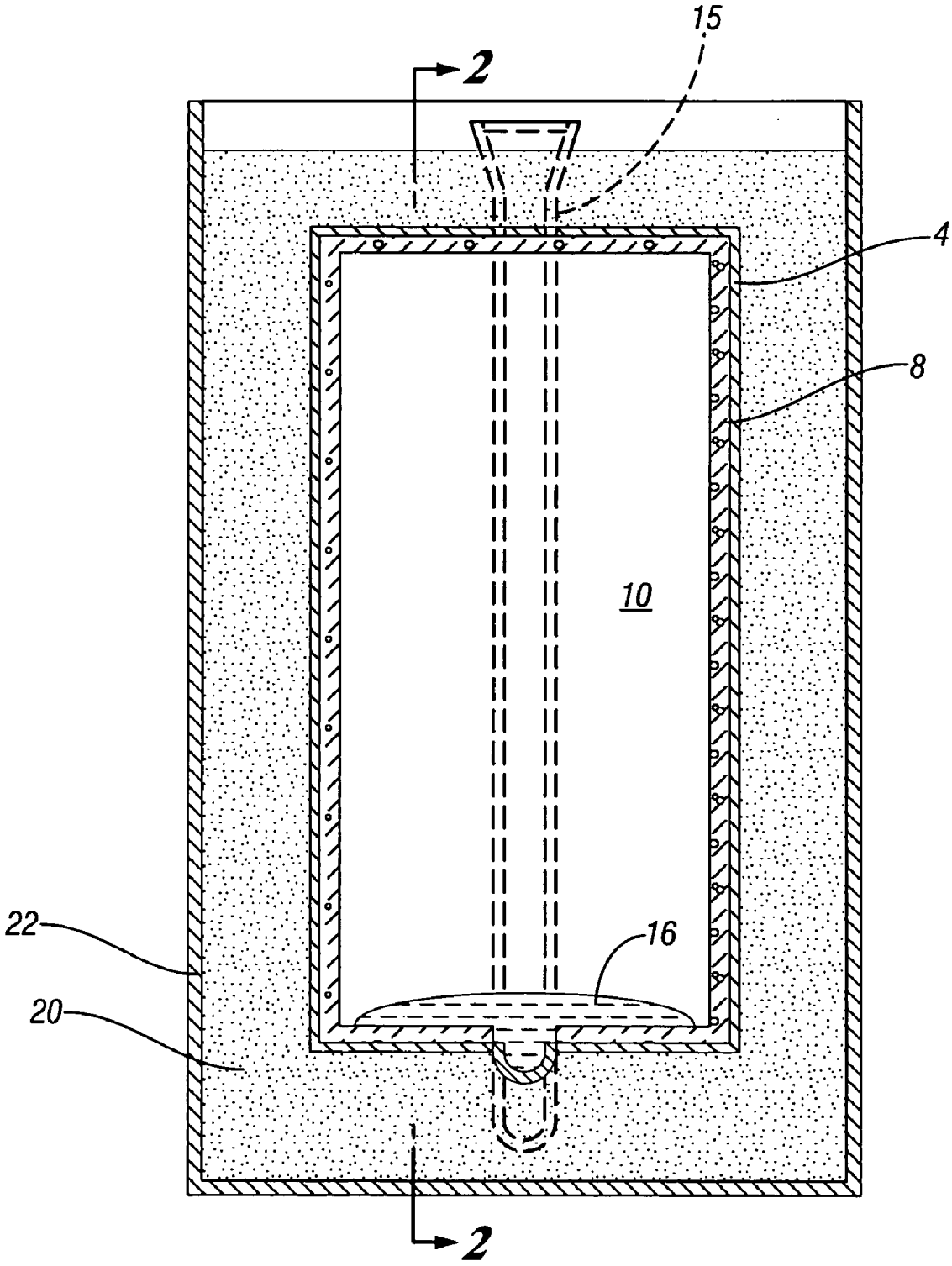
FIG. 2 is a view in the direction 2-2 of FIG. 1.

FIGS. 1 and 2 depict a bottom-fed, gravity-cast lost-foam casting mold including a hydrolysable polymeric foam (e.g. EPS) pattern 2 coated with a permeable refractory coating 4, and spaced from a metal chill 6 by means of a foam spacer 8 that is molded integrally with the pattern 2 at the time the pattern is molded, and takes the form of a continuous ridge, or rib, projecting from and circumscribing a selected surface 12 of the pattern 2. The chill 6 is preferably perimeter-glued to the spacer 8 using a vaporizable glue, ala Runts Jr. et al. supra. The pattern-chill assembly is embedded in a bed of refractory particles 20 (e.g. sand) contained in a metal flask 22 using fluidization and compaction techniques well known to lost-foam process practitioners. The chill 6 has a cooling face 10 that confronts the selected surface 12 of the pattern 2 across a gap 14 therebetween. The gap is at least 0.5 mm wide, and is adapted to be filled with melt in such a way that the advancing metal front therein displaces the collapsing foam pattern and keeps pyrolysis products away from the cooling face 10 of the chill 6. In this embodiment, a vertical, ceramic down-sprue 15 supplies melt 16 through an inlet 18 directly to the gap 14, and thence into the foam pattern 2. The chill 6 is arranged vertically in the mold, and the melt front moves upwardly through the gap 14 so as to sweep any pyrolysis products ahead of it, and out of the gap 14. It then advances laterally into the pattern 2. Once the gap is filled with metal, a barrier is formed that prevents pyrolysis products from reaching, and being trapped against, the cooling face 10 by the melt.

Figure 3:
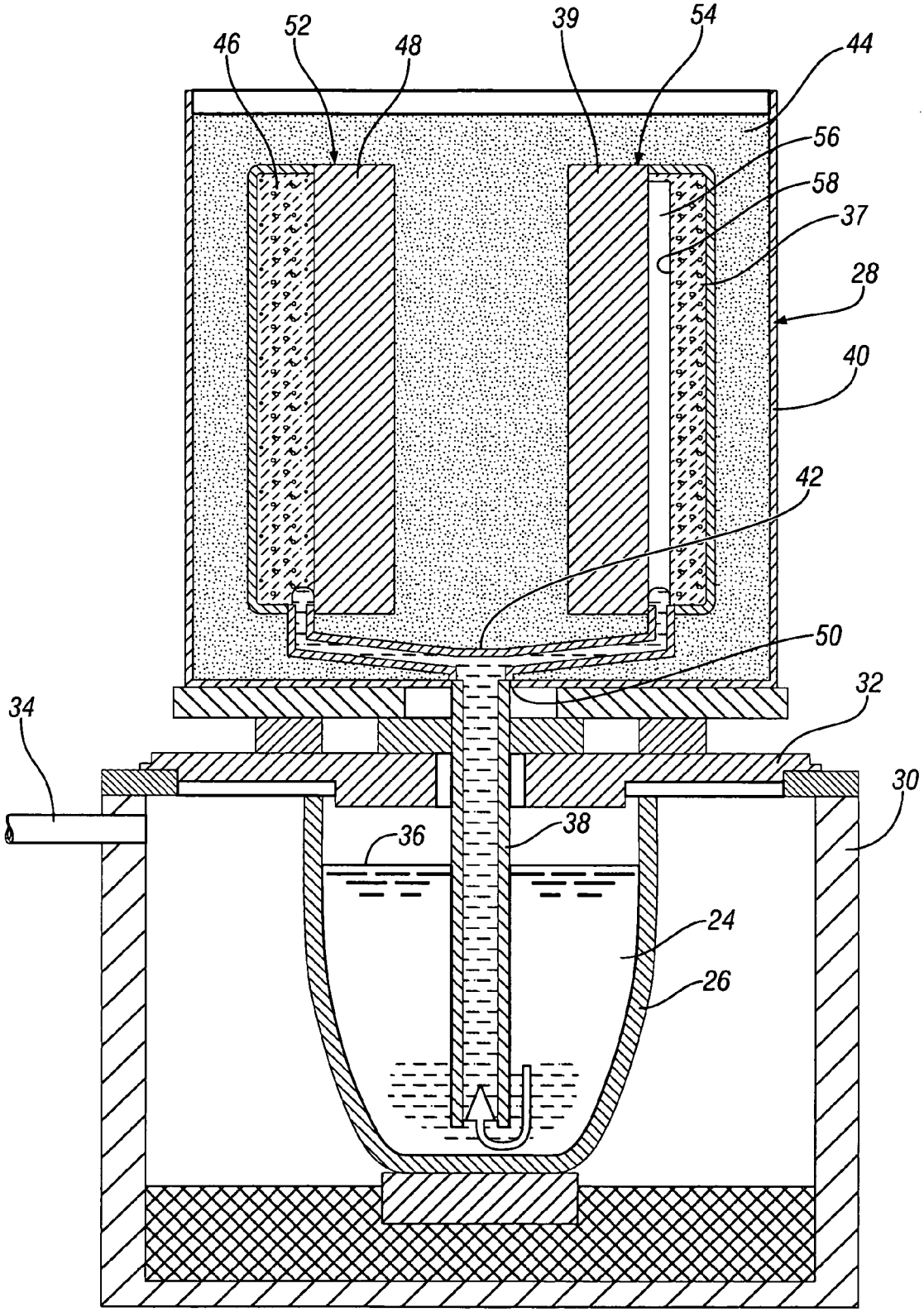
FIG. 3 is sectional view of a low pressure, counter gravity casting vessel with overlying lost-foam mold pattern and chill sets in accordance with another embodiment of the present invention.

FIG. 3 depicts a counter-gravity, low-pressure lost-foam casting process wherein molten metal 24, from an underlying crucible 26, is forced upwardly, by gas pressure, into a lost-foam mold 28 overlying the crucible 26. The mold 28 contains two pattern-chill sets 52 and 54. Set 54 has a gap 56 between the chill 39 and the confronting face 58 of the foam pattern 37, according to the present invention. Set 52 has no such gap, and the foam pattern 46 abuts the chill 48. More specifically, a pressurizable vessel 30 is sealed closed by a cover 32 and contains a heated crucible 26 filled with melt 24. A flask 40 is supported above the crucible 26 by the cover 32. A filler-tube 38 extends from beneath the surface 36 of the melt 24 in the crucible 26 upwardly through the cover 32 and into sealing engagement with an opening 50 in the bottom of flask 40, and communicates with a gating and runner system 42 which connects to the pattern-chill sets 52 and 54. An inlet pipe 34 to the vessel 30 allows pressurized gas (e.g. nitrogen) to be admitted to the vessel 30 to pressurize the vessel 30, and thereby apply pressure on the upper surface 36 of the melt 24. Pressurizing the vessel 30 causes the melt to rise up the filler-tube 38, through the gating and runner system 42, and into the molding cavities occupied by the foam patterns 37 and 46 in the unbonded sand mold 44.

Figure 4:
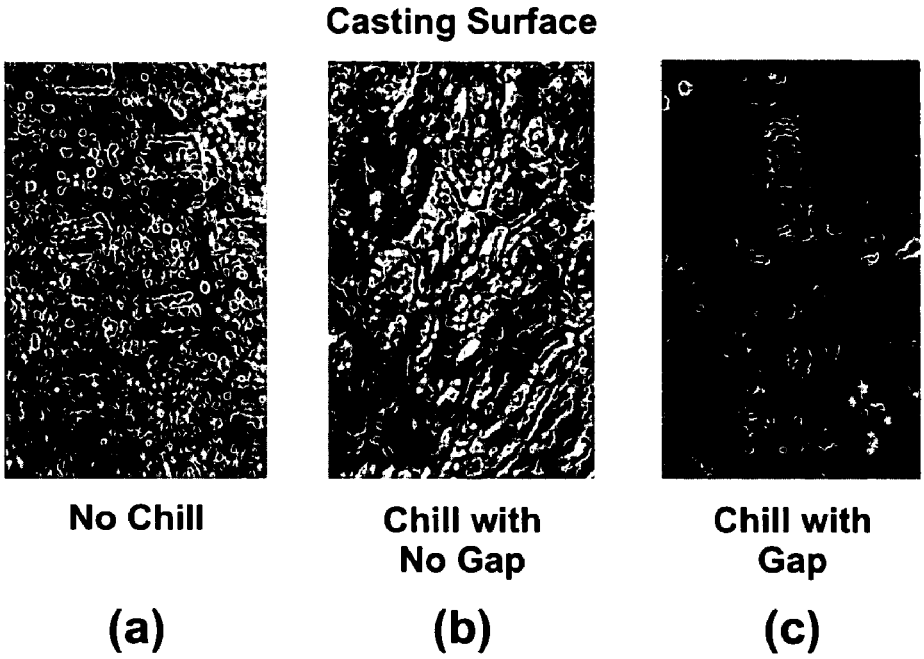
FIG. 4 are photographs of certain surface areas of lost-foam aluminum castings made (a) without a chill, (b) with a chill engaging the pattern's surface, and (c) with a chill spaced from the pattern's surface by a gap in accordance with the present invention.
Figure 5:
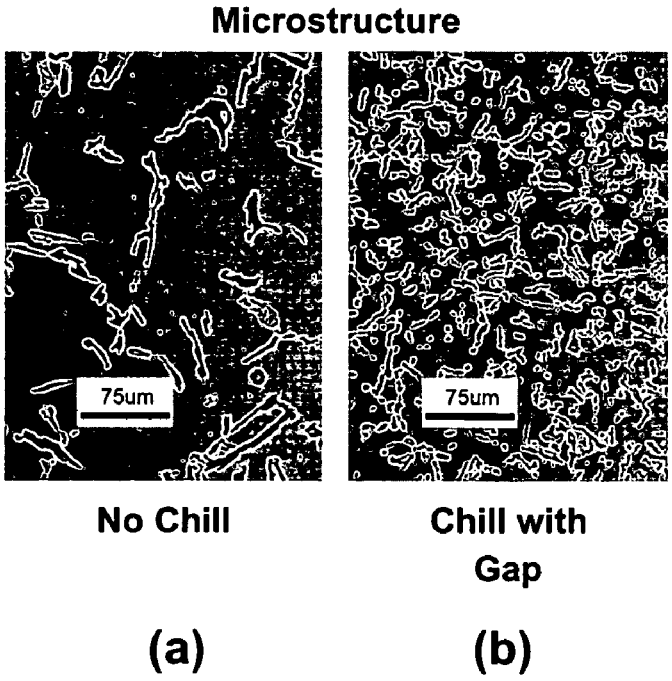
FIG. 5 are photomicrographs of the microstructure of regions of certain aluminum lost-foam castings made (a) without a chill, and (b) with a chill spaced from the casting's pattern by a gap in accordance with the present invention.

FIGS. 4 and 5 are photographs and photomicrographs respectively of A356 aluminum castings simultaneously cast, with and without chills, by the low-pressure technique described in connection with FIG. 3.

EPS patterns 37 and 46 were 15 cm wide by 20 cm high by 12 mm thick. The chills 39 and 48 were 15 cm wide by 20 cm high by 5 cm thick copper. The gap 33 was 4 mm. The chills were perimeter-glued to the patterns, as described above in connection with FIG. 1. The A356 melt was cast using a programmed, variable, nitrogen-imposed pressure in the vessel 30 at a temperature of 775° C. in the crucible 26.

FIG. 4 shows photographs of the surface area of A356 Al castings made (a) without a chill, (b) with a chill whose cooling face contacted the pattern, and (c) with a chill whose cooling face was spaced from the pattern by a 4 mm gap and filled with melt in accordance with the present invention. FIG. 4 (*b*) shows the rough surface of the casting made with the chill contacting the pattern and resulting from the melt trapping pyrolysis products against the cooling face of the chill. In sharp contrast, FIG. 4(*c*) shows the relatively smooth surface of the casting made with a chill spaced from the pattern by a gap in accordance with the present invention.

Similarly, FIG. 5 shows (a) the coarse microstructure of an A356 Al casting made without a chill, and (b) the refined microstructure of a casting made with a chill and gap according to the present invention.

Figure 6:
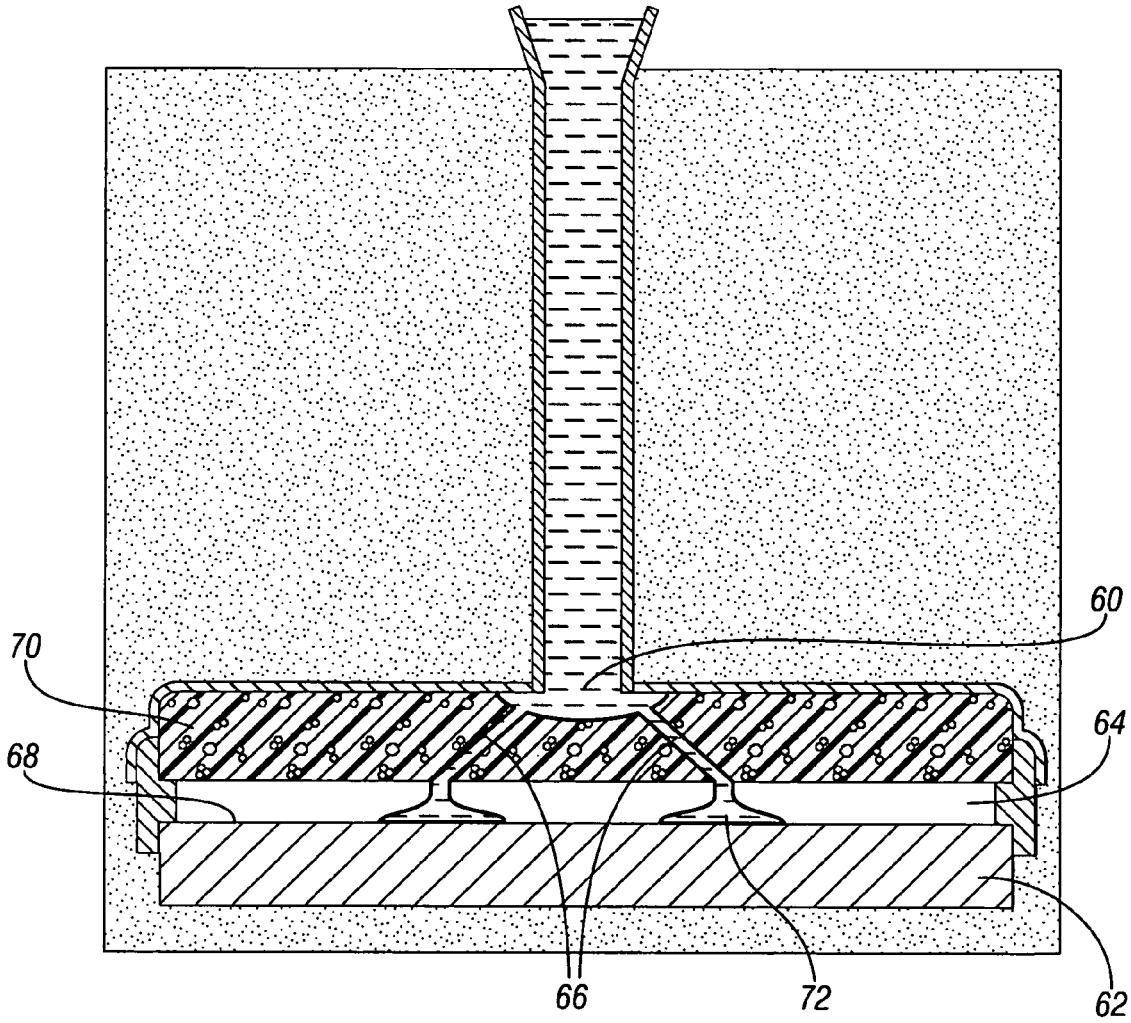
FIG. 6 is a section view of a lost-foam mold with embedded pattern and chill according to still another embodiment of the present invention.

FIG. 6 depicts another embodiment wherein the gate 60 is remote from the chill 62, but flow communicates directly with the gap 64 by means of lighteners 66. In this embodiment, the chill 62 is oriented horizontally in the mold beneath the foam pattern 70, so that the molten metal 72 first begins to spread out over the cooling face 68 of the chill 62 before it rises in the gap 64 into contact with the foam pattern 70. The metal-filled gap prevents any pyrolysis products from reaching the cooling face 68, while the metal front pushes pyrolysis products further away from the cooling face 68.

While the invention has been described in terms of certain specific embodiments thereof, it is not intended to be limited thereto, but rather only to the extent set forth hereafter in the claims which follow.

We claim:

1. In the process for the-lost foam casting of a metal melt selected from the group consisting of aluminum, magnesium and their alloys comprising the principle steps of (a) embedding a pyrolyzable polymeric foam pattern in a mold comprising a bed of unbonded refractory particles to form a molding cavity in said bed, and (b) introducing said melt into said molding cavity to pyrolyze said foam into pyrolysis products, displace said pattern with said melt and shape said melt in said cavity, the improvement comprising: positioning a chill having a cooling face opposite a selected surface of said pattern such that said cooling face confronts said selected portion and is spaced from said selected surface by a gap having a width greater than 0.5 mm; introducing said melt into said gap so as to displace any pyrolysis products in said gap away from said cooling face and prevent entrapment of pyrolysis products by said melt against said face.

2. The process according to claim 1 including forming a spacer integrally with said pattern to so position said chill, and adhering said chill to said spacer.

3. A process according to claim 1 comprising introducing said melt first into said gap and thence into said molding cavity.

4. A process according to claim 1 wherein said mold includes a gate at a site remote from said chill for admitting said melt into said cavity at said site, an inlet for admitting said melt into said gap, and a lightener communicating said gate with said inlet, comprising substantially simultaneously supplying melt to said molding cavity and to said lightener for rapid transport to said gap before said selected surface pyrolizes.

5. A process according to claim 1 wherein the pyrolizable polymeric foam pattern has a vertical surface and a chill is positioned with a vertical cooling face opposite the vertical surface of the pattern to form a vertical gap, and wherein the melt introduced into the molding cavity moves upwardly through the vertical gap.

6. A process according to claim 5 in which the gap has a width greater than about one-half millimeter up to and including about four millimeters.

7. A process according to claim 1 in which the gap has a width greater than about one-half millimeter up to and including about four millimeters.

* * * * *